US005635030A

United States Patent [19]

Meschenmoser

[11] Patent Number: 5,635,030

[45] Date of Patent: Jun. 3, 1997

[54] PROCESS AND DEVICE FOR GUIDING A MATERIAL WEB

[75] Inventor: Andreas Meschenmoser, Horgenzell, Germany

[73] Assignee: Voith Sulzer Papiermaschinen GmbH, Heidenheim, Germany

[21] Appl. No.: 404,470

[22] Filed: Mar. 14, 1995

[30] Foreign Application Priority Data

Mar. 15, 1994 [DE] Germany ..... 44 08 713.6

[51] Int. Cl.[6] ..... D21F 1/36; B65H 23/24; B65H 20/14

[52] U.S. Cl. ..... 162/193; 162/306; 162/307; 226/7

[58] Field of Search ..... 162/193, 289, 162/306, 307, 200; 226/7, 197

[56] References Cited

U.S. PATENT DOCUMENTS

| | | | |
|---|---|---|---|
| 1,338,094 | 4/1920 | Pope . | |
| 2,052,869 | 9/1936 | Coanda | 239/418 |
| 3,419,207 | 12/1968 | Amend, Jr. | 226/97 |
| 3,999,696 | 12/1976 | Reba et al. . | |
| 4,136,808 | 1/1979 | Reba | 226/7 |
| 4,147,287 | 4/1979 | Reba | 226/7 |
| 4,539,075 | 9/1985 | Majamiemi . | |
| 4,543,160 | 9/1985 | Kerttula et al. | 162/193 |
| 4,664,443 | 8/1987 | Kerttula et al. | 162/255 |
| 4,888,094 | 12/1989 | Weisshuhn et al. . | |
| 4,893,741 | 1/1990 | Heinzmann | 226/196 |
| 4,897,158 | 1/1990 | Weisshuhn et al. . | |
| 4,898,643 | 2/1990 | Weisshuhn et al. . | |
| 4,923,567 | 5/1990 | Liedes et al. | 162/193 |

FOREIGN PATENT DOCUMENTS

| | | |
|---|---|---|
| 0326535 | 8/1989 | European Pat. Off. . |
| 2548795 | 3/1977 | Germany . |
| 2854887 | 7/1979 | Germany . |
| 2912152 | 10/1980 | Germany . |
| 9109313 | 11/1991 | Germany . |
| 2097766 | 11/1982 | United Kingdom . |
| 86-01844 | 3/1986 | WIPO . |
| 93-22495 | 11/1993 | WIPO . |

OTHER PUBLICATIONS

European Search Report.
German Patent Application P4408713.6.
European Patent Office Search RS 93165.

*Primary Examiner*—Donald E. Czaja
*Assistant Examiner*—Jose A. Fortuna
*Attorney, Agent, or Firm*—Greenblum & Bernstein P.L.C.

[57] ABSTRACT

Process an device for guiding a material web. The invention pertains to a method and apparatus for guiding a material web or strip thereof toward and around a movable guide element, in a simple and safe manner, which is achieved in that, for example, in the press portion of a papermaking machine, a strip of a paper web is brought into the vicinity of a rotating guide roller and, there, an air jet extending nearly tangentially, relative to the rotatable guide roller of a blast nozzle, serves for the transport to a subsequent unit.

5 Claims, 1 Drawing Sheet

PROCESS AND DEVICE FOR GUIDING A MATERIAL WEB

CROSS REFERENCE TO RELATED APPLICATIONS

This application claims the priority of German Application No. DE-P 4408713.6, filed Mar. 15, 1994, the disclosure of which is incorporated herein by reference in its entirety.

BACKGROUND OF THE INVENTION

1. Field of the Invention

This invention pertains to a method and an apparatus associated therewith for the guiding of a light weight, flexible material web or at least a strip thereof in a machine for the treatment of the material web and along a portion of a moving guide element, particularly for forwarding a strip of a paper web in a papermaking machine and along a portion of a rotating guide roller. This invention can also be utilized, besides in papermaking machines, for the transfer of plastic or metal foils as well as for transferring textile fibers.

2. Discussion of the Background of the Invention and Material Information

European Patent Publication EP-PS-326535 discloses a method and an apparatus for the cutting and guiding of a lead-in band from a smooth-surface roller in a press to a desired location. This is achieved via the use of two air streams, wherein one air stream, directed against the outer surface of the roller, severs the lead-in band and frees same from the roller, and wherein the other air stream, via the production of a negative pressure region, further conveys the band along a guide plate.

A disadvantage of the noted solution is that these installations require a lot of room which limits the accessibility to the machine and inhibits the addition of further devices, such as for example, steam blasters or of a twin scraper. In addition, at this narrow portion, paper jams can occur, which lead to damage within the entire press section of the papermaking machine. The contamination of the guiding plate, via the paper web, should also be noted, in connection herewith.

It is also well known to sever the paper strip via the use of a manually actuated blast device and convey same to a rotating roller, wherein the length of time and success of this working procedure depend to a large extent upon the experience and know-how of the machine foreman.

It is the task or object of this invention, to produce a method and an associated apparatus, which will assure a safe and simple guiding of the material web or of a strip thereof, toward a moving guide element and which only minimally inhibits access to the entire apparatus.

SUMMARY OF THE INVENTION

The task or object of this invention is accomplished via a method for the guidance of at least a strip of a light weight, flexible, material web in a machine for the treatment of the material web and along a portion of a movable guide element, the method comprising: introducing a first guiding air jet in the vicinity of the guide element, between a portion of the material web being guided and the guide element; and keeping the velocity of the air, of the first air jet, greater than the velocity of the guide element.

A further embodiment of the method of this invention further includes keeping, at the impingement of the air jet upon the guide element, the direction of the movement of both the air jet and the guide element, about the same.

An additional embodiment of the method of this invention further includes diverting the first air jet and the portion of the material web being guided thereby from the guide element, via a non-moving guide device, to a subsequent unit in the machine for treatment.

A yet further embodiment of the method of this invention further includes diverting the first air jet and the portion of the material web being guided thereby to a subsequent unit in the machine for treatment with the aid of a further air jet.

Another embodiment of the method of this invention further includes moving an air jet, resulting from a combination of the first and further air jets, on its way to the subsequent unit, for a portion of the way, along a non-moving guide device.

A still differing embodiment of the method of this invention further includes bringing the first air jet and the portion of the material web being guided thereby, to the vicinity of a differing guide element; and introducing a further air jet between the portion of the material web being guided and the differing guide element, with the effect of the further air jet upon the material web surpassing the effect of the first air jet.

This invention also specifically includes a device for carrying out a method for the guidance of at least a strip of a light weight, flexible, paper web in a papermaking machine at and along a portion of a rotating guide roller, the device including a blast nozzle, arranged between the strip of the paper web in the vicinity of the guide roller, and the guide roller, and a guiding air jet of the blast nozzle extending, in a direction of guidance of the paper web, nearly tangentially with reference to the guide roller.

In another embodiment of the device of this invention, an additional roller is located in the vicinity of the guide roller for advancing the paper web from an advance unit of the papermaking machine, located upstream thereof.

In a further embodiment of the device of this invention, at least one additional blast nozzle is associated with the additional roller, in the vicinity of the rotating guide roller, for severing a guiding strip of the paper web.

In a differing embodiment of the device of this invention, the additional roller is associated with a scraper, with the scraper serving to remove a non-guided portion of the paper web.

In yet another embodiment of the device of this invention, the location of the rotating guide roller, is adjustable, and, after the completed transfer of the entire width of the paper web, the guide roller is increasingly moved into juxtaposition with the paper web.

In yet a further embodiment of the device of this invention, the rotating guide roller is provided, at the end of a paper web guiding region, with a guide plate for deflecting the guiding air jet and the portion of the paper web being carried thereby, toward a subsequent unit of the papermaking machine. Preferably, the guide plate extends for only a portion of the way toward the subsequent unit.

In still a further embodiment of the device of this invention, the rotating guide roller, is provided, at the end of a paper web guidance region, with a further blast nozzle for deflecting the guiding air jet and the portion of the paper web being carried thereby, from the rotating guide roller toward a subsequent unit of the papermaking machine.

In still a differing embodiment of the device of this invention, a guide plate extends between the further blast nozzle and the subsequent unit. Preferably the guide plate is adjustable in one of its orientation and position.

In still a further differing embodiment of the device of this invention, the advance unit is a press apparatus and that the subsequent unit is one of a press apparatus and a drying apparatus for the paper web.

In a final embodiment of the device of this invention, the velocity of the rotatable guide roller deviates slightly from the velocity of the paper web.

Since a guiding air jet is introduced in the vicinity of the guide element, between the guiding portion of the material web and the moving guide element, the velocity of the air of the air jet or stream is greater than the velocity of the guide element, thus providing a simple and safe solution, which is particularly apparent during the use of this method in an apparatus for guiding a strip of a paper web on and along a portion of a rotating guide roller within a papermaking machine.

The herein utilized effect is the so-called "Coanda-Effect". This term describes the property of a liquid or a gas stream to adhere itself in the vicinity of an adjacent wall and to flow therealong. In case the wall is formed by a cylinder, it is possible, under some circumstances, that the stream reaches an envelopment angle of more than 180°. It is thus explainable that the stream carries along fluid elements from its surroundings, whereby a negative pressure region occurs between the stream and the wall, which in turn directs the stream toward the wall. This invention improves thereupon in that the stream, that is the suction effect emanating therefrom, is utilized for the transporting or conveying of the material web and is thus restricted in its use to light weight and flexible material webs.

It is advantageous, when at the impingement of the air jet onto the guide element, the direction of movement of both is about equal. An inclination of the air jet, relative to the guide element, can also be useful. The negative pressure, caused by the air jet also aids in the removal of the material web from the conveying guide element and leads to the acquisition or carrying-along of same.

Guiding elements, in addition to rotating cylinders also include endless recirculating bands. Several possibilities exist for the deviation or deflection of the air jet or stream and the portion of the material web being conveyed thereby. On one hand, this can be achieved via a non-moving guide arrangement located near the guide element and/or a further air jet, and, on the other hand, the material web, via the use of the same effect, can be acquired by a differing but also movable guide element. In the latter instance it must be assured that the air jet, responsible for the noted acquisition, must have a greater effect than the conveying air jet. It should also not be overlooked that the guide element itself may already be a portion of or part of the following or subsequent unit which further treats the material web.

The process of this invention is not only simple and safe, but also requires but a few elements for the realization thereof. This is shown in the already mentioned utilization of the method in a papermaking machine an particularly then, when the advance or upstream unit is a press apparatus and the subsequent or downstream unit is a press or drying apparatus. The rotating guide roller, which functions as a guide element, can be driven at a velocity which differs slightly from the velocity of the paper web, which leads to self-cleaning of the guide roller.

The acquisition of the paper web is preferably accomplished via a roller situated in the vicinity of the guide roller, with there, of course, also being other possibilities.

The acquisition roller is however a simple variation of the solution, in order to sever the strip of the material web being carried or to be guided via a further blast nozzle, to lift or separate same from the conveying or acquisition roller and to bring same in the vicinity of the guide roller. The portion of the paper web which is not to be guided can hereby be removed and conveyed therefrom via a scraper attached at the roller. Such a construction, at the same time, counteracts a paper jam. In case the guide roller is adjustably mounted, it can upon completion of the transfer of the complete width paper web, be further immersed or plunged into contact with the paper web in order to carry out its function of being a guide roller during normal machine operation.

As has already been described, there are several possibilities in order to again separate the strip from the guide roller and convey same to a subsequent unit, whereby guiding can be accomplished via a guide plate and/or further blast nozzles. These elements are provided at the end of the paper web guide region. The guide plate should only extend over a portion of the distance to the subsequent unit, so that the air jet can widen itself until it reaches the subsequent unit and thereby negate any negative consequences thereof upon the function of the subsequent unit via the carrying in of excessive air streams.

For the adaption of the differing operating conditions and/or types of papers, it is advantageous if the blast nozzles are adjustable in their flow direction or their mounting and that the guide plates are adjustable in their alignment or their location. After the transfer of the paper web, in the interest of access to the papermaking machine, it can be advantageous if the blast nozzles can be movable from the area of the papermaking machine.

BRIEF DESCRIPTION OF THE DRAWINGS

The invention will be better understood and objects other than those set forth above will become apparent when consideration is given to the following detailed description thereof. Such description, which pertains to two embodiments of this invention, makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
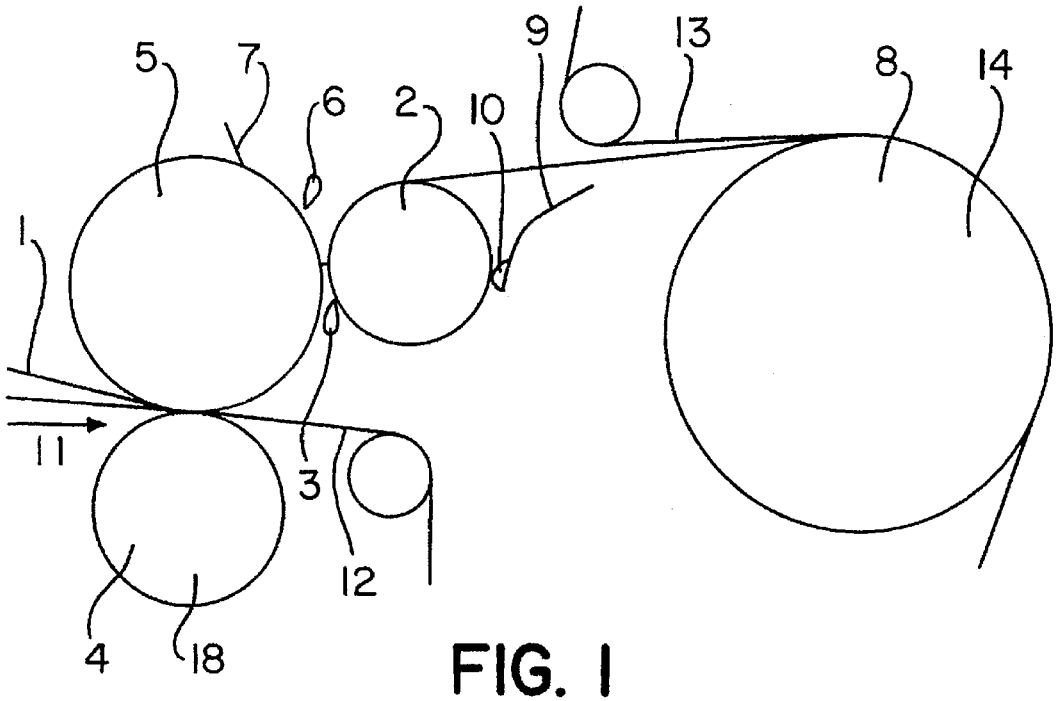
FIG. 1 is a schematic side view of a portion of a papermaking machine showing a first embodiment of the invention.

The first embodiment, as per FIG. 1, pertains to a front or advance unit 4, in the form of a press apparatus, which consists of rollers or cylinders 5 and 18, which together form the dehydration or water removal gap or nip. Together with paper web or paper path 1, a pulp or dehydration felt 12 is also conducted, guided or conveyed through the dehydration gap. Paper web 1 is brought, with the side facing away from dehydration felt 12 and adhering to upper roller 5, into the vicinity of a movable guide element, which here takes the form of a rotating guide roller 2.

For the transfer of paper web 1, an edge strip is separated via the use of blast nozzle 6 and removed via roller 5. The air jet of the blast nozzle must therefore include a component that is perpendicular to the upper surface of roller 5, as well as a component that acts in a direction opposite to that of web moving direction 11. The same can however, for example, also be achieved via the use of a separation scraper which is combined with a blast nozzle. The remainder of paper web 1, if necessary, is subsequently removed from roller 5 by means of scraper 7 and carried off.

For the guidance of the strip of paper web 1, at and along a portion of rotating guide roller 2, a blast nozzle 3 is interposed or arranged between the strip of paper web 1 and guide roller 2, whose air jet is arranged nearly tangential with reference to guide roller 2, in the guiding direction, wherein the velocity of the air jet is greater than the velocity of the guide roller 2.

Associated with guide roller 2 , at about the end of the paper web guiding region is a blast nozzle 10 which deviates or deflects the guiding air jet of blast nozzle 3, and the strip of the paper web carried thereby, from guide roller 2, to a following or subsequent unit 8. The air jet of blast nozzle 10 is guided hereby over a portion of the way or distance via a guide plate 9.

Subsequent or downstream unit 8, in this example, takes the form of a drying apparatus, in which paper web 1 is guided over several drying cylinders 14. In order to press paper web 1 onto drying cylinders 14, an endless circumferential drying sieve or screen 13 is additionally utilized. The strip of paper web or path 1 that is to be transferred must therefore only be transported into the gap or nip between the first drying cylinder 14 and drying screen 13. Once the lead-in of the strip has been achieved, the strip width can slowly be increased until the entire width paper web 1 runs through units 4 and 8.

Figure 2:
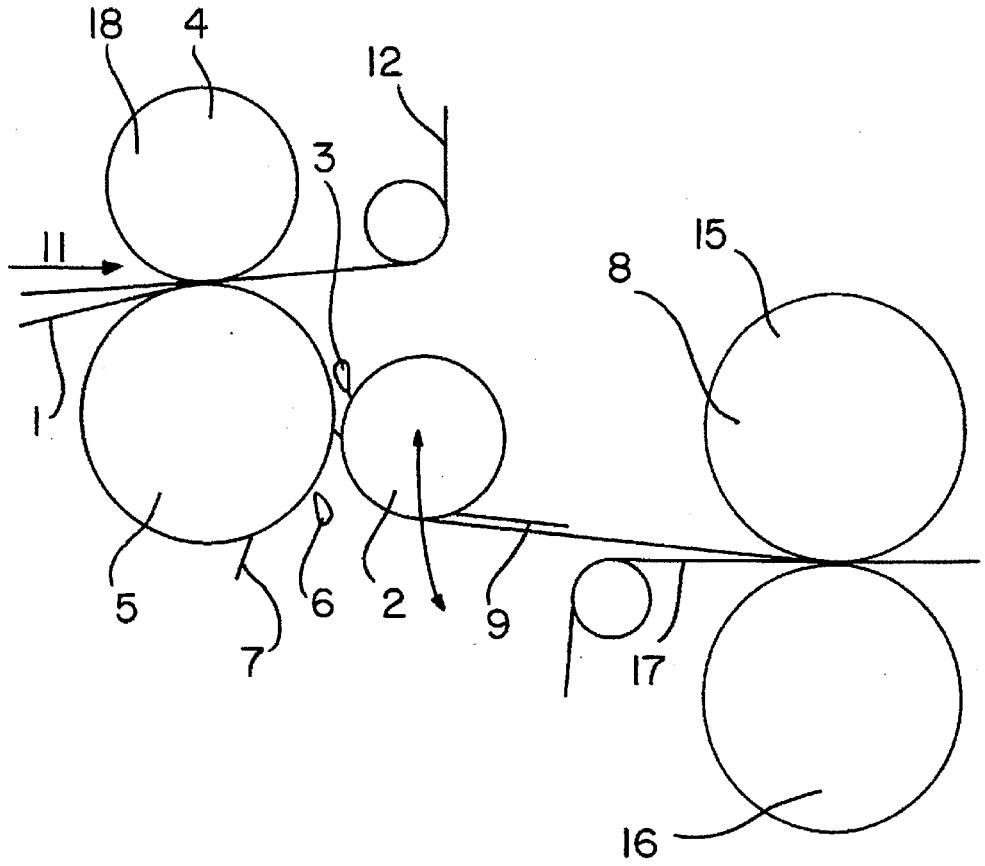
FIG. 2 is a schematic side view of a second embodiment thereof.

In the embodiment illustrated in FIG. 2, advance unit 4 also pertains to a press apparatus consisting of two rollers 5 and 18, wherein, in addition to paper web 1, a pulp or hydration felt 12 also runs through the dehydration gap or nip. However, this differs from FIG. 1 in that guiding roller 5 for paper web 1, in the vicinity of rotating guide roller 2, is located at the bottom. This has advantages, particularly with reference to the carrying away of the rest of the paper web, removed by scraper 7 from guide roller 2, in the lower portion of the papermaking machine. The separation and lifting off of the edge strip of the paper web, which is to be transferred, is achieved via a blast nozzle 6.

Likewise, in the same manner as in FIG. 1, the strip is conveyed along a portion of rotating guide roller 2 via a blast nozzle 3. However, at about the end of the paper web guiding region of guiding roller 2, a guide plate 9 deflects the air jet of blast nozzle 3 and the strip of paper web being conveyed therewith from guide roller 2 toward subsequent unit 8, with guide plate 9 however extending for only a portion of the way or distance toward subsequent unit 8. Thereby, since guide plate 9, in both instances, does not extend all the way to subsequent unit 8, the air jet is provided with the possibility of spreading. In this manner, the negative effects of the air jet, relative to the working result of subsequent unit 8, are counteracted.

Guiding roller 2, due to its location, can be adjustably mounted, so that, especially after the finalized transfer of the entire width paper web 1, it can be increasingly plunged or immersed into paper web 1, for example, to reduce the length of the open draw of paper web 1 to subsequent unit 8. In addition, the velocity of guide roller 2 should deviate slightly from that of paper web 1, this leading to the self-cleaning of this guide element.

Subsequent unit 8, in FIG. 2, is a further press device or apparatus, comprised of two rollers 15 and 16, which can correspond to the press device that is comprised of rollers 5 and 18, whereby a pulp or hydration felt 17, together with paper web 1, is also conveyed through the press gap or nip. The strip to be transferred thus must be transported only into the gap between dehydration felt 17 and roller 15. Dehydration felts 12 and 17, in the FIG. 2 example, are each located on a different side of paper web 1, via which the uniformity of both sides is sought to be assured. In addition, second press felt 17, which here extends at the bottom, can carry the strips during lead-in.

In order to be adjustable for changing conditions, at least a portion of blast nozzles 3, 6 and 10 should be adjustable in their effective direction or in their positions, and/or guide plate 9 should be adjustable in its orientation or position. Blast nozzles 3, 6 and 10 need to extend only for the width of the strip of paper web 1 being transferred and can, after completion of the transfer of the full width of paper web 1, be shut off. In case blast nozzle 3, associated with guide roller 2, produces an air jet, which in addition to the tangential component thereof also includes an axially extending component, with reference to guide roller 2, which, for example, is possible due to an appropriate location of blast nozzle 3, the strip of paper web 1, due to the spiral-shaped air current or flow around guide roller 2, can be conveyed, via the air jet, to an axially offset guide cable which serves for the further transport of the strip.

This device or apparatus is not only simply and safely constructed, but also assures the transfer of the strip to subsequent unit 8 in the shortest possible distance and without reversal, thus reducing the danger of tear-off.

The trouble-free use of this invention is possible with plastic or metal foils as well as with textile fabrics.

It is also feasible that the guiding air jet, eventually at reduced strength, assists in the guiding of the full width web during normal operation, thus counteracting a tear-off. In this instance, instead of the rotating guide roller, even a nonrotatable or fixed guide element can be utilized. If the paper web, or strip thereof, is conveyed from rotating guide roller 2 to a further and also rotating roller by means of an additional stronger air jet, via the use of the same effect, the open draw of paper web 1 can therewith be reduced between units 4 and 8.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A method for guiding at least a strip of a light weight, flexible, material web in a machine for the treatment of the material web and along a portion of a movable guide element, the method comprising:

introducing at least one guiding air jet in a vicinity of the movable guide element, between a portion of the guided material web and the movable guide element;

keeping the velocity of the air, of the at least one air jet, greater than the velocity of the movable guide element; and diverting the at least one air let and the portion of the guided material web from the movable guide element, via a fixed guide device, to a subsequent unit in the machine for treatment.

2. The method of claim 1, further including:

keeping, at the impingement of the at least one air jet upon the movable guide element, the direction of the movement of both the at least one air jet and the movable guide element about the same.

3. A method for guiding at least a strip of a light weight, flexible, material web in a machine for the treatment of the material web and along a portion of a movable guide element, the method comprising:

introducing at least one guiding air let in a vicinity of the movable guide element, between a portion of the guided material web and the movable guide element;

keeping the velocity of the air, of the at least one air jet, greater than the velocity of the movable guide element; and diverting the at least one air jet and the portion of the guided material web to a subsequent unit in the machine with the aid of at least one further air jet.

4. The method of claim 3, further including directing at least a portion of the at least one air jet and the at least one further air jet toward the subsequent unit along a non-moving guiding device.

5. A method for guiding at least a strip of a light weight, flexible, material web in a machine for the treatment of the material web and along a portion of a movable guide element, the method comprising:

introducing at least one guiding air let in a vicinity of the movable guide element, between a portion of the guided material web and the movable guide element;

keeping the velocity of the air, of the at least one air jet, greater than the velocity of the movable guide element; and bringing the at least one air jet and the portion of the guided material web to a vicinity of a second guide element; and introducing a further air jet between the portion of the guided material web and the second guide element, the further air jet having greater influence upon the material web than the at least one air jet.

* * * * *